US005619816A

United States Patent [19]

Ellison

[11] Patent Number: 5,619,816

[45] Date of Patent: Apr. 15, 1997

[54] FREE-STANDING DISPLAY FRAME

[76] Inventor: Hillary Ellison, 21 E. 7th St., #5, New York, N.Y. 10003

[21] Appl. No.: 607,151

[22] Filed: Feb. 26, 1996

[51] Int. Cl.[6] ..... G09F 1/12

[52] U.S. Cl. ..... 40/738

[58] Field of Search ..... 40/737, 738, 661, 40/780, 787

[56] References Cited

U.S. PATENT DOCUMENTS

| | | | |
|---|---|---|---|
| 2,373,074 | 4/1945 | Ziemmerman | 40/787 |
| 2,391,420 | 12/1945 | Huber | 40/737 X |
| 3,721,030 | 3/1973 | Steinhardt | 40/780 |
| 3,812,609 | 5/1974 | Volden | 40/780 |
| 3,952,437 | 4/1976 | Mitchell | 40/738 X |
| 4,149,332 | 4/1979 | Horwitt | 40/780 |
| 4,196,535 | 4/1980 | Heimo | 40/737 X |
| 4,283,869 | 8/1981 | Rappa | 40/661 |
| 4,310,976 | 1/1982 | Wilten | 40/737 |

FOREIGN PATENT DOCUMENTS

| | | | |
|---|---|---|---|
| 2196845 | 5/1988 | United Kingdom | 40/737 |

*Primary Examiner*—Joanne Silbermann
*Attorney, Agent, or Firm*—Michael Ebert

[57] ABSTRACT

A free-standing frame for a photo, a printed painting or any other sheet having decorative or informative data to be displayed. The frame is formed by a pair of superposed flexible plastic panels, at least the face panel being transparent, the sheet to be displayed being sandwiched therebetween. Threaded through holes in the panels is a cord which in the flat state of the frame has overlying the face panel a pair of parallel vertical cord sections on either side of the sandwiched sheet, and a pair of parallel horizontal cord sections behind the rear panel joining the ends of the vertical cord sections to define an endless cord rectangle which serves to loosely hold the panels together. When the rear cord sections are hooked together at their centers and converge to create a holding node, the resultant flexing of the panels which are then under tension acts to compress the sheet therebetween to maintain its frame position and to more effectively display the sheet. The frame is then in a curved state in which it can sit upright on a horizontal surface or be suspended by its node from a wall. When the hook is released, the frame then recovers its flat state in which it may be conveniently packed and shipped.

8 Claims, 2 Drawing Sheets

FREE-STANDING DISPLAY FRAME

BACKGROUND OF INVENTION

1. Field of Invention

This invention relates generally to frames for supporting and displaying photo, printed pictures or any other sheet having decorative or informative data, and more particularly to a free-standing frame formed of a pair of superposed flexible plastic panels between which the sheet to be displayed is sandwiched.

2. Status of Prior Art

The usual way to frame a photograph, a printed picture or any other sheet to be displayed, is to provide a frame whose branches are formed of metal, wood or other material, the sheet being placed within the frame adjacent a transparent front pane of glass or acrylic plastic. The frame is provided with a back cover secured thereto to enclose the sheet within the frame.

When the sheet dimensions are smaller than those of the frame, a mat is provided to border the sheet and maintain it at a proper position for display within the frame. A typical frame is not free standing, and should one wish to put the frame in an upright position on a table or other horizontal surface, one must provide an easel or stand for this purpose.

And in order to suspend the frame from a wall, a string must be attached to the frame bridging the side branches thereof. A typical frame, particularly one having a glass pane, cannot be safely packed in a suitcase, or shipped or sent in the mail.

The Mukai et al. U.S. Pat. No. 3,694,947 discloses a picture frame having a transparent plastic face plate with bent edges which resiliently engage corresponding bent edges of a plastic rear plate, a picture being mounted on the rear of the face plate. A string attached to the back plate makes it possible to suspend this frame from a wall. And to stand the frame on a desk, an easel is hinged to its back plate.

To provide a three-dimensional viewing effect for a picture, the Knox U.S. Pat. No. 3,041,762 sandwiches the picture between a pair of flexible panels which are flexed so that the edges thereof fit into grooves formed in the long sides of a rectangular frame, the picture then being curved to provide the desired three dimensional viewing effect.

The Halpern U.S. Pat. No. 4,750,283 shows a picture display device for displaying photos or other graphic material constructed of two pieces of semi-rigid flexible transparent plastic that are pre-folded to form a free-standing device having a three-sided triangular shape, the photo being sandwiched between the pieces. In the Heimo U.S. Pat. No. 4,196,535 pictures are sandwiched between front and rear plastic panels which have a corrugated curvature, the front panel being transparent.

SUMMARY OF INVENTION

In view of the foregoing, the main object of the invention is to provide a free-standing frame in which a photo or other sheet bearing decorative of informative data to be displayed in sandwiched between superposed flexible panels, at least the face panel being transparent, which panels are convertible from a flat state to a curved state in which the sandwiched sheet is subjected to pressure to maintain its frame position.

More particularly, an object of this invention is to provide a frame of the above type having a cord associated therewith which when parallel rear sections of the cord are pulled together and linked at their centers to create a holding node, then causes the frame to assume a curved state, the frame reverting to a flat state when the rear sections of the cord are unlinked.

Among the significant advantages of a frame in accordance with the invention are the following:

A. Only a simple step is required for a user to convert the frame from its flat state to a curved state.

B. When in its curved state, the frame may be placed in an upright position on a table or other horizontal surface, or suspended from a wall.

C. When in its flat state, the frame occupies little space and may be safely packed in a suitcase, or shipped in a shallow box or sent through the mail.

D. Though thin and lightweight, the frame is not fragile.

E. The photo or other sheet sandwiched between the panels is always protected thereby, yet it is a simple matter to exchange one sheet for another to be displayed.

Also an object of the invention is to provide a high-quality and attractive display frame which is inexpensive to manufacture.

Briefly stated, these objects are attained by a free-standing frame for a photo, a printed painting or any other sheet having decorative or informative data to be displayed. The frame is formed by a pair of superposed flexible plastic panels, at least the face panel being transparent, the sheet to be displayed being sandwiched therebetween.

Threaded through holes in the panels is a cord which in the flat state of the frame has overlying the face panel a pair of parallel vertical cord sections on either side of the sandwiched sheet, and a pair of parallel horizontal sections behind the rear panel joining the ends of the vertical cord sections to define an endless cord rectangle which serves to loosely hold the panels together in the flat state.

When the rear cord sections are hooked together at their centers to converge and create a holding node, the resultant flexing of the panels which are then under tension acts to compress the sheet therebetween to maintain its frame position and to more effectively display the sheet. The frame is then in a curved state in which it can sit upright on a horizontal surface or be suspended by its node from a wall. When the hook is released, the frame then recovers its flat state in which it may be conveniently packed and shipped.

BRIEF DESCRIPTION OF DRAWINGS

For a better understanding of the invention, as well as further object and features thereof, reference is made to the detailed description thereof to be read in conjunction with the accompanying drawings wherein.

DESCRIPTION OF INVENTION

Figure 1:
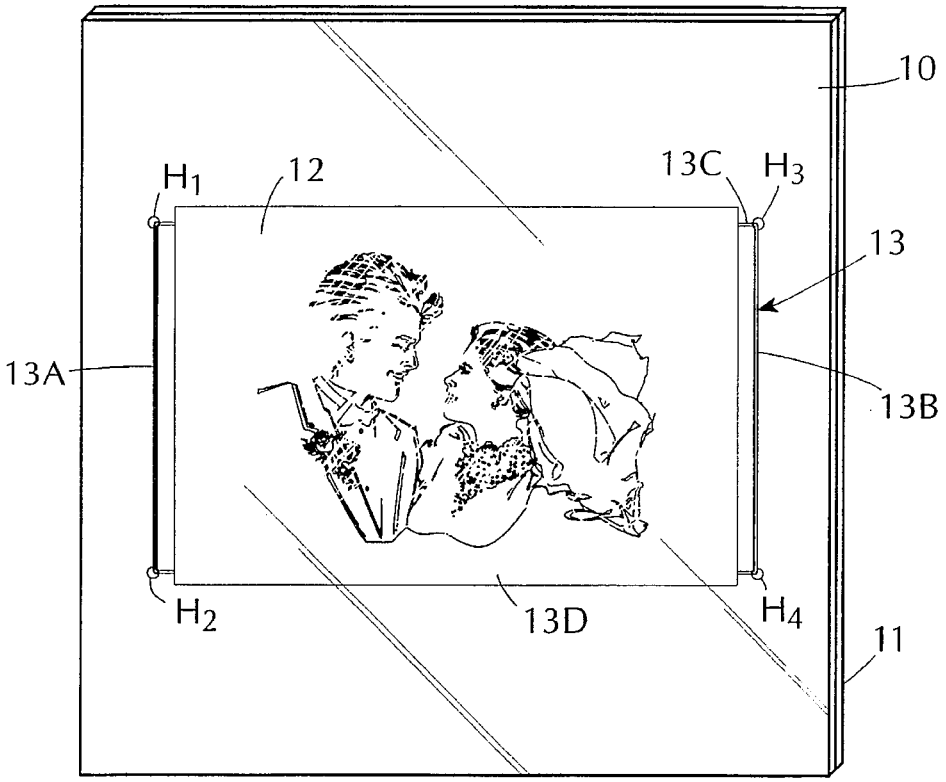
FIG. 1 is a front view of a display frame in accordance with the invention in its flat state.
Figure 2:
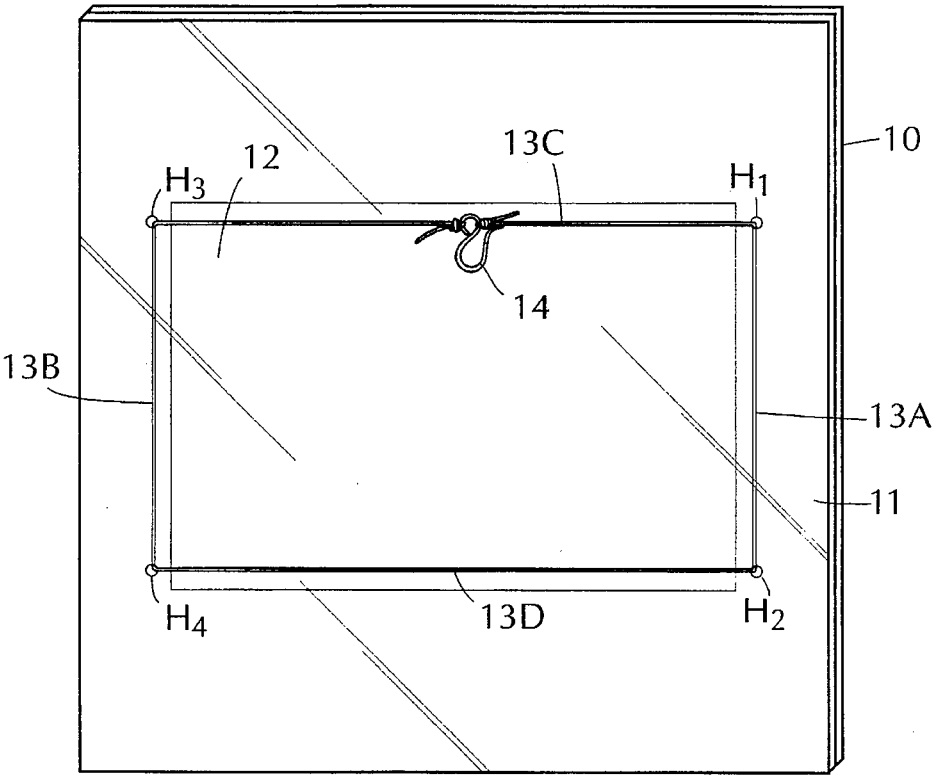
FIG. 2 is a rear view of the frame in its flat state.

Referring now to FIGS. 1 and 2 showing a display frame in accordance with the invention in its flat state, it will be seen that the frame is formed by superposed rectangular panels 10 and 11 of semi-rigid or stiff flexible synthetic plastic material, such as polypropylene, acrylic or PVC.

The size of the frame depends on the dimensions of a photo 12 sandwiched between the panels, or whatever other sheet is to be displayed by .the frame. Thus the sandwiched sheet may be a print, a printed picture, a printed advertisement, a restaurant menu or any other sheet bearing decorative or informative material to be displayed. Hence in practice, the frame may be made available in a range of different sizes, or may be custom-made to accommodate a sheet of a particular size.

The face or front panel 10 must be transparent, but the rear panel 11 need not be, for it may be made of translucent or opaque plastic material. Should the rear panel be made of a colored opaque plastic, it then acts effectively as a mat which borders the framed photo.

Bored through superposed panels 10 and 11 at the corners of an invisible rectangle whose dimensions are larger than those of the photo or sheet 12 to be displayed but smaller than those of the rectangular panels, are four holes $H_1$ to $H_4$. Threaded through these holes is a length of cord 13 which serves to hold these panels together. Cord 13 is preferably formed of nylon or other high-strength cord material, but it may also be formed of cotton string, a fishing line or a ribbon.

When so threaded, then overlying face panel 10 are parallel vertical cord sections 13A and 13B which are spaced from either side of the photo to be sandwiched between the panels, the ends of these vertical sections going through the holes to join, as shown in FIG. 2, parallel upper and lower horizontal cord sections 13C and 13D which are behind rear panel 11.

Figure 3:
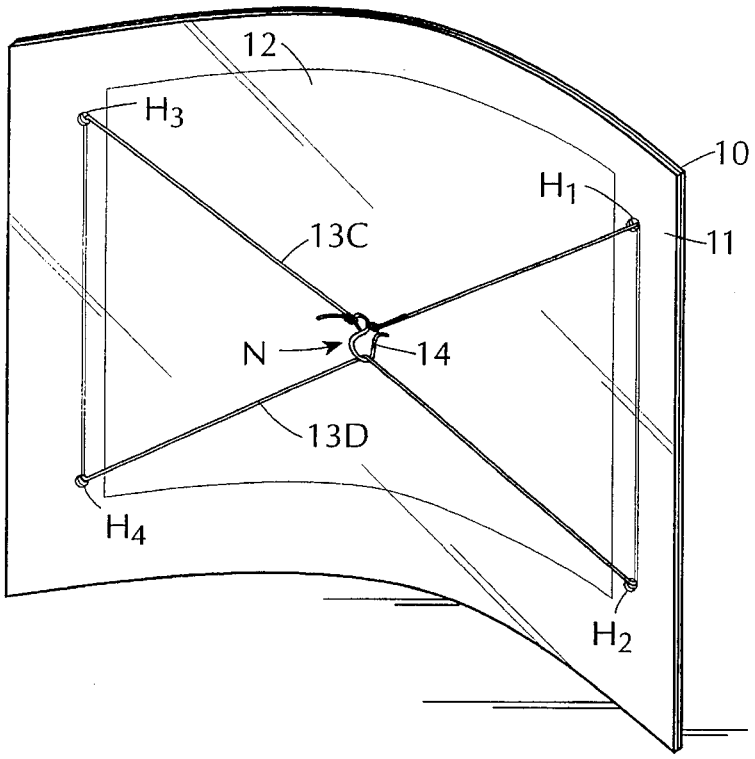
FIG. 3 is a rear view of the frame in its curved state.
Figure 5:
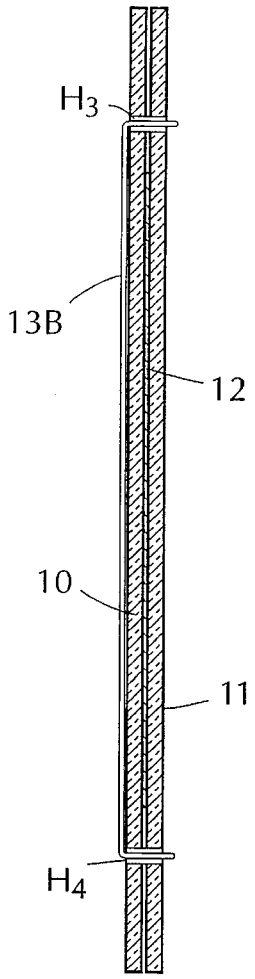
FIG. 5 is a transverse section taken through the frame in its flat state.

The horizontal upper cord section 13C behind rear panel 11 is tied or otherwise attached at its center to the eye of a hook 14 adapted to hook onto the lower horizontal cord section 13D and its center to converge these sections to create a holding node N as shown in FIG. 3.

In the flat state of the frame, as shown in FIG. 2, the rear cord sections 13C and 13D are parallel to each other and panels 10 and 11 are then loosely held together so that one may slip photo 12 therebetween to sandwich the photo 12 between the panels, or to remove a sandwiched photo and replace it with another sheet to be displayed.

To convert the frame to its curved state, then as shown in FIG. 3, hook 14 on upper cord section 13C is then pulled into engagement with lower cord section 13D to create the holding node N. In doing so, the frame is caused to assume its curved state, and the cord at the rear of the frame then takes on a bow-tie configuration to tightly hold the panels together.

Figure 4:
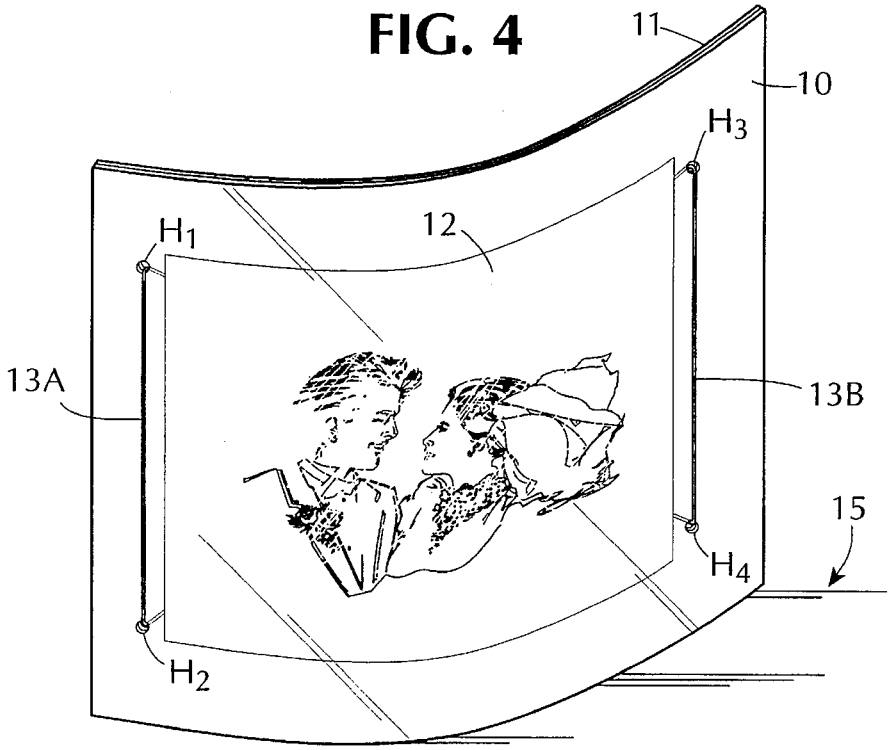
FIG. 4 is a front view of the frame in its curved state.

When superposed panels 10 and 11 are flexed to assume the curved state, the panels are tensioned to compress the photo sandwiched therebetween to maintain it at its desired position within the frame to best display the photo. And because the framed picture is curved, as shown in FIG. 4, its display assumes a three-dimensional form and is easier for an observer to view than a planar picture which is best seen only when the viewer is at right angles to the plane of the picture at its center.

To cause the frame to revert to its flat state, hook 14 is released, the panels then resuming their normal planar form in which the photo, because the panels are now loosely held together by the cord, can now be removed from between the panels.

In its curved state, the frame is free-standing and may be placed on a table or other horizontal surface 15. Or the frame in its curved state may be suspended on the wall from a picture hanger driven therein adapted to engage node N at the rear of the frame; the vertical edges of the curved frame then lying against the wall.

The panels forming the frame need not be rectangular and may assume other shapes as long as the lower edge of the frame is straight. And in practice, logos or other identifying indicia may be silk screened or sandblasted on the plastic face panel of the frame at a position that does not interfere with the photo or other sheet being displayed.

Thus in a restaurant, the free-standing frame may be used to display a menu or wine list sandwiched between the panels. Or a large scale frame in accordance with the invention, may be used to display advertisements or promotional material at a trade show booth in which the free-standing frame in its curved state is placed on a table or floor.

While there has been shown a preferred embodiment of the invention, it is to be understood that many modifications may be made without departing from the essential spirit of the invention. Thus when photos of a standard rectangular size are to be displayed in the frame, the rear panel may have guide marks printed or otherwise applied thereto at the corners of a rectangle to indicate the proper position to be occupied by an inserted photo. And it is not essential that the rear panel be formed of plastic material, for it may be formed of cardboard or thin aluminum sheeting.

I claim:

1. A free-standing frame displaying a photo or other sheet inserted in the frame bearing decorative or informative data to be displayed, said frame comprising:

A. a pair of normally planar superposed flexible panels formed by a face panel and a rear panel, at least the face panel being transparent; and B. a length of cord threaded through holes bored in the superposed panels at the corners of a rectangle, the cord threaded through said holes defining a pair of parallel vertical cord sections overlying the face panel on either side of the photo or other sheet inserted between the panels and sandwiched thereby, and a pair of horizontal upper and lower cord sections behind the rear panel joining the vertical cord sections at the holes to hold these panels together loosely when the frame is in a flat state; and C. detachable means linking the upper horizontal cord section to the lower horizonal cord section at their centers to create a holding node and to cause the panels to flex to convert the frame to a curved state in which the frame is free standing, said panels in the curved state being tightly held together to compress the sheet sandwiched therebetween to maintain its frame position.

2. A frame as set forth in claim 1, in which the detachable means is a hook having an eye to which the upper horizontal cord is attached at its center, the hook being engagable with the lower horizontal cord section at its center.

3. A frame as set forth in claim 1, in which the front panel is formed of transparent plastic material.

4. A frame as set forth in claim 1, in which the rear panel is formed of translucent or opaque plastic material.

5. A frame as set forth in claim 1, in which the panels are formed of semi-rigid polypropylene.

6. A frame as set forth in claim 1, in which the panels are formed of synthetic acrylic material.

7. A frame as set forth in claim 1, in which the cord is formed of nylon.

8. A frame as set forth in claim 1, in which the superposed panels have a rectangular form.

* * * * *